US009530375B2

(12) United States Patent
Xiao

(10) Patent No.: US 9,530,375 B2
(45) Date of Patent: Dec. 27, 2016

(54) SCAN DRIVING CIRCUIT

(71) Applicant: SHENZHEN CHINA STAR OPTOELECTRONICS TECHNOLOGY CO., LTD., Shenzhen, Guangdong (CN)

(72) Inventor: Juncheng Xiao, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 143 days.

(21) Appl. No.: 14/417,204

(22) PCT Filed: Nov. 19, 2014

(86) PCT No.: PCT/CN2014/091640

§ 371 (c)(1),
(2) Date: Jan. 26, 2015

(87) PCT Pub. No.: WO2016/074264

PCT Pub. Date: May 19, 2016

(65) Prior Publication Data

US 2016/0140928 A1 May 19, 2016

(30) Foreign Application Priority Data

Nov. 14, 2014 (CN) ..... 2014 1 0650257

(51) Int. Cl.
*G09G 5/00* (2006.01)
*G09G 3/36* (2006.01)

(52) U.S. Cl.
CPC ..... *G09G 3/3696* (2013.01); *G09G 3/3648* (2013.01); *G09G 3/3674* (2013.01);
(Continued)

(58) Field of Classification Search
CPC ..... G09G 3/36; G09G 3/3648; G09G 3/3674; G09G 3/3677; G09G 3/3696; G09G 2300/0408; G09G 2310/0213; G09G 2310/0267; G09G 2310/0286; G09G 2330/021; G11C 19/28; H03K 17/6871
See application file for complete search history.

(56) References Cited

U.S. PATENT DOCUMENTS

2010/0134399 A1* 6/2010 Ki ..... G09G 3/3677 345/94
2014/0103983 A1 4/2014 Chang et al.
(Continued)

FOREIGN PATENT DOCUMENTS

CN 103021360 A 4/2013
CN 104050941 A 9/2014

*Primary Examiner* — Joe H Cheng

(57) ABSTRACT

A scan driving circuit is disclosed, and the scan driving circuit has a pull-up control module, a pull-up module, a pull-down module, a pull-down maintaining module, a down-stream module, a bootstrap capacitor, and a constant-voltage low-level source; the constant-voltage low-level source includes a first constant-voltage low-level source which provides a first low-level and a second constant-voltage low-level source which provides a second low-level; and an absolute value of the first low-level is smaller than an absolute value of the second low-level. The reliability of the scan driving circuit is thus improved.

20 Claims, 8 Drawing Sheets

(52) U.S. Cl.
CPC ... *G09G 3/3677* (2013.01); *G09G 2300/0426* (2013.01); *G09G 2310/0213* (2013.01); *G09G 2310/0267* (2013.01); *G09G 2310/061* (2013.01); *G09G 2330/021* (2013.01); *G09G 2330/027* (2013.01)

(56) References Cited

U.S. PATENT DOCUMENTS

2014/0192039 A1* 7/2014 Wang ..... G11C 19/28 345/213
2015/0279288 A1* 10/2015 Dai ..... G02F 1/13306 345/690
2015/0371599 A1 12/2015 Xiao
2016/0005372 A1* 1/2016 Yu ..... G09G 3/3677 345/208
2016/0125830 A1* 5/2016 Xiao ..... G09G 3/3677 345/92
2016/0126948 A1* 5/2016 Xiao ..... H03K 17/6871 327/109
2016/0140922 A1* 5/2016 Dai ..... G09G 3/3648 345/92
2016/0164514 A1* 6/2016 Xiao ..... H03K 17/687 327/109
2016/0171949 A1* 6/2016 Dai ..... G11C 19/00 345/212
2016/0180788 A1* 6/2016 Xiao ..... G09G 3/3677 345/204
2016/0189649 A1* 6/2016 Xiao ..... G09G 3/3648 345/214
2016/0189652 A1* 6/2016 Xiao ..... G02F 1/13 327/109

* cited by examiner

SCAN DRIVING CIRCUIT

FIELD OF THE INVENTION

The present invention relates to a field of display driving, and more particularly to a scan driving circuit.

BACKGROUND OF THE INVENTION

A gate driver on array is abbreviated as a GOA which generates a scan driver circuit on an existing array substrate of the thin film transistor liquid crystal display (TFT-LCD), in order to implement a driving method which progressively scans for scan lines. A structural diagram of an existing scan driving circuit is illustrated in FIG. 1, and the scan driving circuit 10 includes a pull-up control module 101, a pull-up module 102, a down-stream module 103, a pull-down module 104, a bootstrap capacitor 105, and a pull-down maintaining module 106.

When the scan driving circuit 10 works in a high-temperature state, a threshold voltage of a switch transistor moves to a negative value, so as to lead the switch transistor of each module of the scan driving circuit 10 to easily have an electrical leakage problem, which affects the reliability of the scan driving circuit.

As a result, it is necessary to provide a scan driving circuit to solve the problems existing in the conventional technologies.

SUMMARY OF THE INVENTION

A primary object of the present invention is to provide a scan driving circuit that has a smaller electrical leakage problem and a higher reliability, which solves the easily occurring electrical leakage problem of the existing scan driving circuit, which affects the reliability of the scan driving circuit.

To solve the above problem, the technical solution of the present invention is as follows:

A scan driving circuit is provided in an embodiment of the present invention, the scan driving circuit is used to execute a driving operation for cascaded scan lines, and comprises:

a pull-up control module receiving a previous-level down-stream signal, and generating a scan level signal corresponding to one of the scan lines according to the previous-level down-stream signal;

a pull-up module pulling up a scan signal of the corresponding scan line according to the scan level signal and a present-level clock signal;

a pull-down module pulling down a scan signal of the corresponding scan line according to a next-level down-stream signal;

a pull-down maintaining module keeping the scan signal of the corresponding scan line in a low-level;

a down-stream module transmitting a present-level down-stream signal to a next-level pull-up control module;

a bootstrap capacitor generating a high-level of the scan signal of the scan line;

a reset module executing a reset operation for the scan level signal of the present-level scan line;

a constant-voltage low-level source, comprising:

a first constant-voltage low-level source providing a first low-level to the pull-down maintaining module, wherein the first low-level pulls down the scan signal; and a second constant-voltage low-level source providing a second low-level to the pull-down maintaining module, wherein the second low-level pulls down the scan level signal and the down-stream signal;

wherein an absolute value of the first low-level is smaller than an absolute value of the second low-level;

wherein the pull-up control module comprises a first switch transistor, a control end of the first switch transistor inputs the previous-level down-stream signal, an input end of the first switch transistor inputs the constant high-level, and an output end of the first switch transistor is connected to the pull-up module, the pull-down module, the pull-down maintaining module, the down-stream module, and the bootstrap capacitor.

In the scan driving circuit of the present invention, the pull-up module comprises a second switch transistor, a control end of the second switch transistor is connected to the output end of the first switch transistor of the pull-up control module, an input end of the second switch transistor inputs the present-level clock signal, and an output end of the second switch transistor outputs a present-level scan signal.

In the scan driving circuit of the present invention, the down-stream module comprises a third switch transistor, a control end of the third switch transistor is connected to the output end of the first switch transistor of the pull-up control module, an input end of the third switch transistor inputs the present-level clock signal, and an output end of the third switch transistor outputs the present-level down-stream signal.

In the scan driving circuit of the present invention, the pull-down module comprises a fourth switch transistor, a control end of the fourth switch transistor inputs the next-level down-stream signal, an input end of the fourth switch transistor is connected to the output end of the first switch transistor of the pull-up control module, and an output end of the fourth switch transistor is connected to the second constant-voltage low-level source.

In the scan driving circuit of the present invention, the pull-down module comprises a fifth switch transistor, a control end of the fifth switch transistor inputs the next-level down-stream signal, an input end of the fifth switch transistor is connected to the output end of the third switch transistor, and an output end of the fifth switch transistor is connected to the constant-voltage low-level source.

In the scan driving circuit of the present invention, the pull-down maintaining module comprises a first pull-down maintaining unit, a second pull-down maintaining unit, a twenty-second switch transistor, and a twenty-third switch transistor;

wherein a control end of the twenty-second switch transistor is connected to the output end of the first switch transistor, an output end of the twenty-second switch transistor is connected to a reference point K(N), and an input end of the twenty-second switch transistor is connected to a reference point P(N);

wherein a control end of the twenty-third switch transistor inputs a previous-level down-stream signal, an output end of the twenty-third switch transistor is connected to the reference point K(N), and an input end of the twenty-third switch transistor is connected to the reference point P(N);

wherein the first pull-down maintaining unit includes a sixth switch transistor, a seventh switch transistor, an eighth switch transistor, a ninth switch transistor, a tenth switch transistor, a eleventh switch transistor, a twelfth switch transistor, and a thirteenth switch transistor;

wherein a control end of the sixth switch transistor is connected to the reference point K(N), an input end of the sixth switch transistor is connected to the first constant-voltage low-level source, and an output end of the sixth switch transistor is connected to the output end of the second switch transistor;

wherein a control end of the seventh switch transistor is connected to the reference point K(N), an input end of the seventh switch transistor is connected to the second constant-voltage low-level source, and an output end of the seventh switch transistor is connected to the output end of the first switch transistor;

wherein a control end of the eighth switch transistor is connected to the reference point K(N), an input end of the eighth switch transistor is connected to the constant-voltage low-level source, and an output end of the eighth switch transistor is connected to the present-level down-stream signal;

wherein a control end of the ninth switch transistor is connected to a first high-frequency impulse signal, an input end of the ninth switch transistor is connected to the first high-frequency impulse signal, and an output end of the ninth switch transistor is connected to the reference point K(N);

wherein a control end of the tenth switch transistor is connected to the present-level down-stream signal, an input end of the tenth switch transistor is connected to the constant-voltage low-level source, and an output end of the tenth switch transistor is connected to the first high-frequency impulse signal;

wherein a control end of the eleventh switch transistor is connected to a second high-frequency impulse signal, an input end of the eleventh switch transistor is connected to the first high-frequency impulse signal, and an output end of the eleventh switch transistor is connected to the reference point K(N);

wherein a control end of the twelfth switch transistor is connected to the reference point K(N), an output end of the twelfth switch transistor is connected to the reference point K(N), and an input end of the twelfth switch transistor is connected to the first high-frequency impulse signal;

wherein a control end of the thirteenth switch transistor inputs the previous-level down-stream signal, an input end of the thirteenth switch transistor is connected to the constant-voltage low-level source, and an output end of the thirteenth switch transistor is connected to the first high-frequency impulse signal;

wherein the second pull-down maintaining unit includes a fourteenth switch transistor, a fifteenth switch transistor, a sixteenth switch transistor, a seventeenth switch transistor, a eighteenth switch transistor, a nineteenth switch transistor, a twentieth switch transistor and a twenty-first switch transistor;

wherein a control end of the fourteenth switch transistor is connected to the reference point P(N), an input end of the fourteenth switch transistor is connected to the first constant-voltage low-level source, and an output end of the fourteenth switch transistor is connected to the output end of the second switch transistor;

wherein a control end of the fifteenth switch transistor is connected to the reference point P(N), an input end of the fifteenth switch transistor is connected to the second constant-voltage low-level source, and an output end of the fifteenth switch transistor is connected to the output end of the first switch transistor;

wherein a control end of the sixteenth switch transistor is connected to the reference point P(N), an input end of the sixteenth switch transistor is connected to the constant-voltage low-level source, and an output end of the sixteenth switch transistor is connected to the present-level down-stream signal;

wherein a control end of the seventeenth switch transistor is connected to a second high-frequency impulse signal, an input end of the seventeenth switch transistor is connected to the second high-frequency impulse signal, and an output end of the seventeenth switch transistor is connected to the reference point P(N);

wherein a control end of the eighteenth switch transistor is connected to the present-level down-stream signal, an input end of the eighteenth switch transistor is connected to the constant-voltage low-level source, and an output end of the eighteenth switch transistor is connected to the second high-frequency impulse signal;

wherein a control end of the nineteenth switch transistor is connected to a first high-frequency impulse signal, an input end of the nineteenth switch transistor is connected to the second high-frequency impulse signal, and an output end of the nineteenth switch transistor, and an output end of the nineteenth switch transistor is connected to the reference point P(N);

wherein a control end of the twentieth switch transistor is connected to the reference point P(N), an output end of the twentieth switch transistor is connected to the reference point P(N), and an input end of the twentieth switch transistor is connected to the second high-frequency impulse signal;

wherein a control end of the twenty-first switch transistor inputs the previous-level down-stream signal, an input end of the twenty-first switch transistor is connected to the constant-voltage low-level source, and an output end of the twenty-first switch transistor is connected to the second high-frequency impulse signal.

In the scan driving circuit of the present invention, an electrical potential of the first high-frequency impulse signal is opposite to an electrical potential of the second high-frequency impulse signal.

In the scan driving circuit of the present invention, the constant-voltage low-level source comprises:

a first constant-voltage low-level source providing a first low-level to the pull-down maintaining module, wherein the first low-level pulls down the scan signal;

a second constant-voltage low-level source providing a second low-level to the pull-down maintaining module, wherein the second low-level pulls down the scan level signal; and a third constant-voltage low-level source providing a third low-level to the pull-down maintaining module, wherein the third low-level pulls down the down-stream signal;

wherein an absolute value of the first low-level is smaller than an absolute value of the second low-level, the absolute value of the second low-level is smaller than an absolute value of the third low-level.

In the scan driving circuit of the present invention, an output end of a fifth switch transistor of the pull-down module is connected to the third constant-voltage low-level source, an input end of an eighth switch transistor of the pull-down maintaining module is connected to the third constant-voltage low-level source, and an input end of a fifteenth switch transistor of the pull-down maintaining module is connected to the third constant-voltage low-level source;

wherein an output end of the fourth switch transistor of the pull-down module is connected to the second constant-voltage low-level source; an input end of a seventh switch transistor of the pull-down maintaining module is connected to the second constant-voltage low-level source; an input end of a tenth switch transistor of the pull-down maintaining module is connected to the second constant-voltage low-level source; an input end of a fifteenth switch transistor of the pull-down maintaining module is connected to the second constant-voltage low-level source; and an input end of a eighteenth switch transistor of the pull-down maintaining module is connected to the second constant-voltage low-level source;

wherein an input end of a sixth switch transistor of the pull-down maintaining module is connected to the first constant-voltage low-level source; an input end of a thirteenth switch transistor of the pull-down maintaining module is connected to the first constant-voltage low-level source; an input end of a fourteenth switch transistor of the pull-down maintaining module is connected to the first constant-voltage low-level source; and an input end of a twenty-first switch transistor of the pull-down maintaining module is connected to the first constant-voltage low-level source.

A scan driving circuit is further provided in an embodiment of the present invention, the scan driving circuit is used to execute a driving operation for cascaded scan lines, and comprises:

a pull-up control module receiving a previous-level down-stream signal, and generating a scan level signal corresponding to one of the scan lines according to the previous-level down-stream signal;

a pull-up module pulling up a scan signal of the corresponding scan line according to the scan level signal and a present-level clock signal;

a pull-down module pulling down a scan signal of the corresponding scan line according to a next-level down-stream signal;

a pull-down maintaining module keeping the scan signal of the corresponding scan line in a low-level;

a down-stream module transmitting a present-level down-stream signal to a next-level pull-up control module;

a bootstrap capacitor generating a high-level of the scan signal of the scan line; and a constant-voltage low-level source, comprising:

a first constant-voltage low-level source providing a first low-level to the pull-down maintaining module, wherein the first low-level pulls down the scan signal; and a second constant-voltage low-level source providing a second low-level to the pull-down maintaining module, wherein the second low-level pulls down the scan level signal and the down-stream signal;

wherein an absolute value of the first low-level is smaller than an absolute value of the second low-level.

In the scan driving circuit of the present invention, the pull-up control module comprises a first switch transistor, a control end of the first switch transistor inputs the previous-level down-stream signal, an input end of the first switch transistor inputs the constant high-level, an output end of the first switch transistor is connected to the pull-up module, the pull-down module, the pull-down maintaining module, the down-stream module, and the bootstrap capacitor.

In the scan driving circuit of the present invention, the pull-up module comprises a second switch transistor, a control end of the second switch transistor is connected to the output end of the first switch transistor of the pull-up control module, an input end of the second switch transistor inputs the present-level clock signal, and an output end of the second switch transistor outputs a present-level scan signal.

In the scan driving circuit of the present invention, the down-stream module comprises a third switch transistor, a control end of the third switch transistor is connected to the output end of the first switch transistor of the pull-up control module, an input end of the third switch transistor inputs the present-level clock signal, and an output end of the third switch transistor outputs the present-level down-stream signal.

In the scan driving circuit of the present invention, the pull-down module comprises a fourth switch transistor, a control end of the fourth switch transistor inputs the next-level down-stream signal, an input end of the fourth switch transistor is connected to the output end of the first switch transistor of the pull-up control module, and an output end of the fourth switch transistor is connected to the second constant-voltage low-level source.

In the scan driving circuit of the present invention, the pull-down module comprises a fifth switch transistor, a control end of the fifth switch transistor inputs the next-level down-stream signal, an input end of the fifth switch transistor is connected to the output end of the third switch transistor, and an output end of the fifth switch transistor is connected to the constant-voltage low-level source.

In the scan driving circuit of the present invention, the pull-down maintaining module comprises a first pull-down maintaining unit, a second pull-down maintaining unit, a twenty-second switch transistor and a twenty-third switch transistor;

wherein a control end of the twenty-second switch transistor is connected to the output end of the first switch transistor, an output end of the twenty-second switch transistor is connected to a reference point K(N), and an input end of the twenty-second switch transistor is connected to a reference point P(N);

wherein a control end of the twenty-third switch transistor inputs a previous-level down-stream signal, an output end of the twenty-third switch transistor is connected to the reference point K(N), and an input end of the twenty-third switch transistor is connected to the reference point P(N);

wherein the first pull-down maintaining unit includes a sixth switch transistor, a seventh switch transistor, an eighth switch transistor, a ninth switch transistor, a tenth switch transistor, a eleventh switch transistor, a twelfth switch transistor and a thirteenth switch transistor;

wherein a control end of the sixth switch transistor is connected to the reference point K(N), an input end of the sixth switch transistor is connected to the first constant-voltage low-level source, and an output end of the sixth switch transistor is connected to the output end of the second switch transistor;

wherein a control end of the seventh switch transistor is connected to the reference point K(N), an input end of the seventh switch transistor is connected to the second constant-voltage low-level source, and an output end of the seventh switch transistor is connected to the output end of the first switch transistor;

wherein a control end of the eighth switch transistor is connected to the reference point K(N), an input end of the eighth switch transistor is connected to the constant-voltage low-level source, and an output end of the eighth switch transistor is connected to the present-level down-stream signal;

wherein a control end of the ninth switch transistor is connected to a first high-frequency impulse signal, an input end of the ninth switch transistor is connected to the first high-frequency impulse signal, and an output end of the ninth switch transistor is connected to the reference point K(N);

wherein a control end of the tenth switch transistor is connected to the present-level down-stream signal, an input end of the tenth switch transistor is connected to the constant-voltage low-level source, and an output end of the tenth switch transistor is connected to the first high-frequency impulse signal;

wherein a control end of the eleventh switch transistor is connected to a second high-frequency impulse signal, an input end of the eleventh switch transistor is connected to the first high-frequency impulse signal, and an output end of the eleventh switch transistor is connected to the reference point K(N);

wherein a control end of the twelfth switch transistor is connected to the reference point K(N), an output end of the twelfth switch transistor is connected to the reference point K(N), and an input end of the twelfth switch transistor is connected to the first high-frequency impulse signal;

wherein a control end of the thirteenth switch transistor inputs the previous-level down-stream signal, an input end of the thirteenth switch transistor is connected to the constant-voltage low-level source, and an output end of the thirteenth switch transistor is connected to the first high-frequency impulse signal;

wherein the second pull-down maintaining unit includes a fourteenth switch transistor, a fifteenth switch transistor, a sixteenth switch transistor, a seventeenth switch transistor, a eighteenth switch transistor, a nineteenth switch transistor, a twentieth switch transistor and a twenty-first switch transistor;

wherein a control end of the fourteenth switch transistor is connected to the reference point P(N), an input end of the fourteenth switch transistor is connected to the first constant-voltage low-level source, and an output end of the fourteenth switch transistor is connected to the output end of the second switch transistor;

wherein a control end of the fifteenth switch transistor is connected to the reference point P(N), an input end of the fifteenth switch transistor is connected to the second constant-voltage low-level source, and an output end of the fifteenth switch transistor is connected to the output end of the first switch transistor;

wherein a control end of the sixteenth switch transistor is connected to the reference point P(N), an input end of the sixteenth switch transistor is connected to the constant-voltage low-level source, and an output end of the sixteenth switch transistor is connected to the present-level down-stream signal;

wherein a control end of the seventeenth switch transistor is connected to a second high-frequency impulse signal, an input end of the seventeenth switch transistor is connected to the second high-frequency impulse signal, and an output end of the seventeenth switch transistor is connected to the reference point P(N);

wherein a control end of the eighteenth switch transistor is connected to the present-level down-stream signal, an input end of the eighteenth switch transistor is connected to the constant-voltage low-level source, and an output end of the eighteenth switch transistor is connected to the second high-frequency impulse signal;

wherein a control end of the nineteenth switch transistor is connected to a first high-frequency impulse signal, an input end of the nineteenth switch transistor is connected to the second high-frequency impulse signal, and an output end of the nineteenth switch transistor, and an output end of the nineteenth switch transistor is connected to the reference point P(N);

wherein a control end of the twentieth switch transistor is connected to the reference point P(N), an output end of the twentieth switch transistor is connected to the reference point P(N), and an input end of the twentieth switch transistor is connected to the second high-frequency impulse signal;

wherein a control end of the twenty-first switch transistor inputs the previous-level down-stream signal, an input end of the twenty-first switch transistor is connected to the constant-voltage low-level source, and an output end of the twenty-first switch transistor is connected to the second high-frequency impulse signal.

In the scan driving circuit of the present invention, an electrical potential of the first high-frequency impulse signal is opposite to an electrical potential of the second high-frequency impulse signal.

In the scan driving circuit of the present invention, the constant-voltage low-level source comprises:

a first constant-voltage low-level source providing a first low-level to the pull-down maintaining module, wherein the first low-level pulls down the scan signal;

a second constant-voltage low-level source providing a second low-level to the pull-down maintaining module, wherein the second low-level pulls down the scan level signal; and a third constant-voltage low-level source providing a third low-level to the pull-down maintaining module, wherein the third low-level pulls down the down-stream signal;

wherein an absolute value of the first low-level is smaller than an absolute value of the second low-level, the absolute value of the second low-level is smaller than an absolute value of the third low-level.

In the scan driving circuit of the present invention, an output end of a fifth switch transistor of the pull-down module is connected to the third constant-voltage low-level source, an input end of an eighth switch transistor of the pull-down maintaining module is connected to the third constant-voltage low-level source, and an input end of a fifteenth switch transistor of the pull-down maintaining module is connected to the third constant-voltage low-level source;

wherein an output end of the fourth switch transistor of the pull-down module is connected to the second constant-voltage low-level source; an input end of a seventh switch transistor of the pull-down maintaining module is connected to the second constant-voltage low-level source; an input end of a tenth switch transistor of the pull-down maintaining module is connected to the second constant-voltage low-level source; an input end of a fifteenth switch transistor of the pull-down maintaining module is connected to the second constant-voltage low-level source; and an input end of a eighteenth switch transistor of the pull-down maintaining module is connected to the second constant-voltage low-level source;

wherein an input end of a sixth switch transistor of the pull-down maintaining module is connected to the first constant-voltage low-level source; an input end of a thirteenth switch transistor of the pull-down maintaining module is connected to the first constant-voltage low-level source; an input end of a fourteenth switch transistor of the pull-down maintaining module is connected to the first constant-voltage low-level source; and an input end of a twenty-first switch transistor of the pull-down maintaining module is connected to the first constant-voltage low-level source.

In the scan driving circuit of the present invention, the scan driving circuit further comprises:

a reset module executing a reset operation for the scan level signal of the present-level scan line.

In contrast to an existing scan driving circuit, through setting constant-voltage low-level source with many different electrical potentials, the present invention can avoid an electrical leakage problem successfully so as to improve the reliability of a scan driving circuit; the present invention solves the easily occurring electrical leakage problem of the existing scan driving circuit, which affects the reliability of the scan driving circuit.

To allow the above description of the present invention to be more clear and comprehensive, there are preferred embodiments with the accompanying figures described in detail below.

DETAILED DESCRIPTION OF THE PREFERRED EMBODIMENTS

Figure 1:
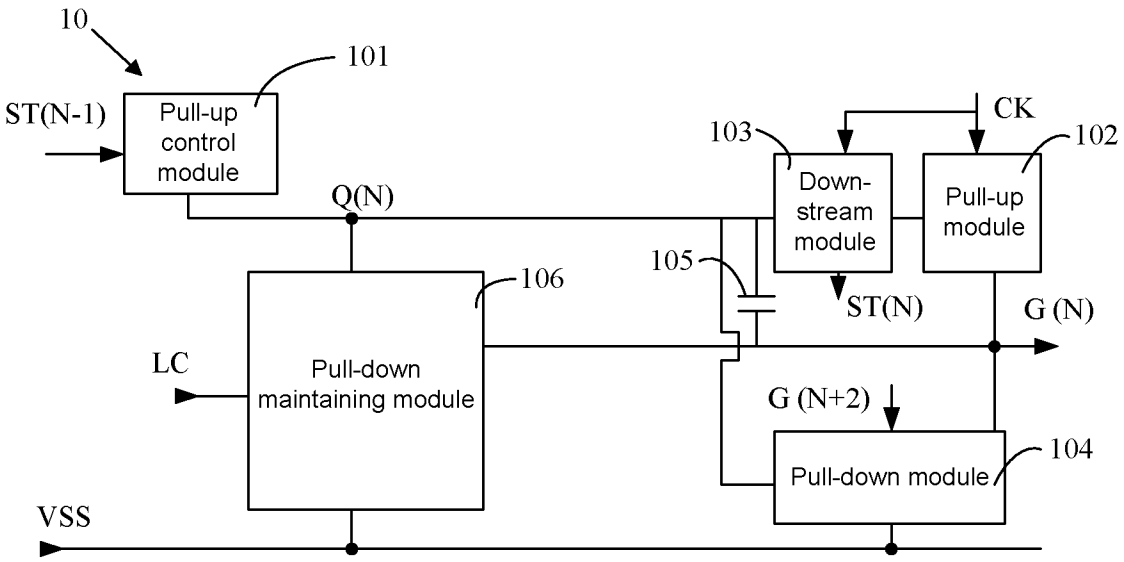
Fig.1 Prior Art
FIG. 1 is a structural diagram of an existing scan driving circuit.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

In the drawings, units with similar structures are represented with the same label.

Figure 2:
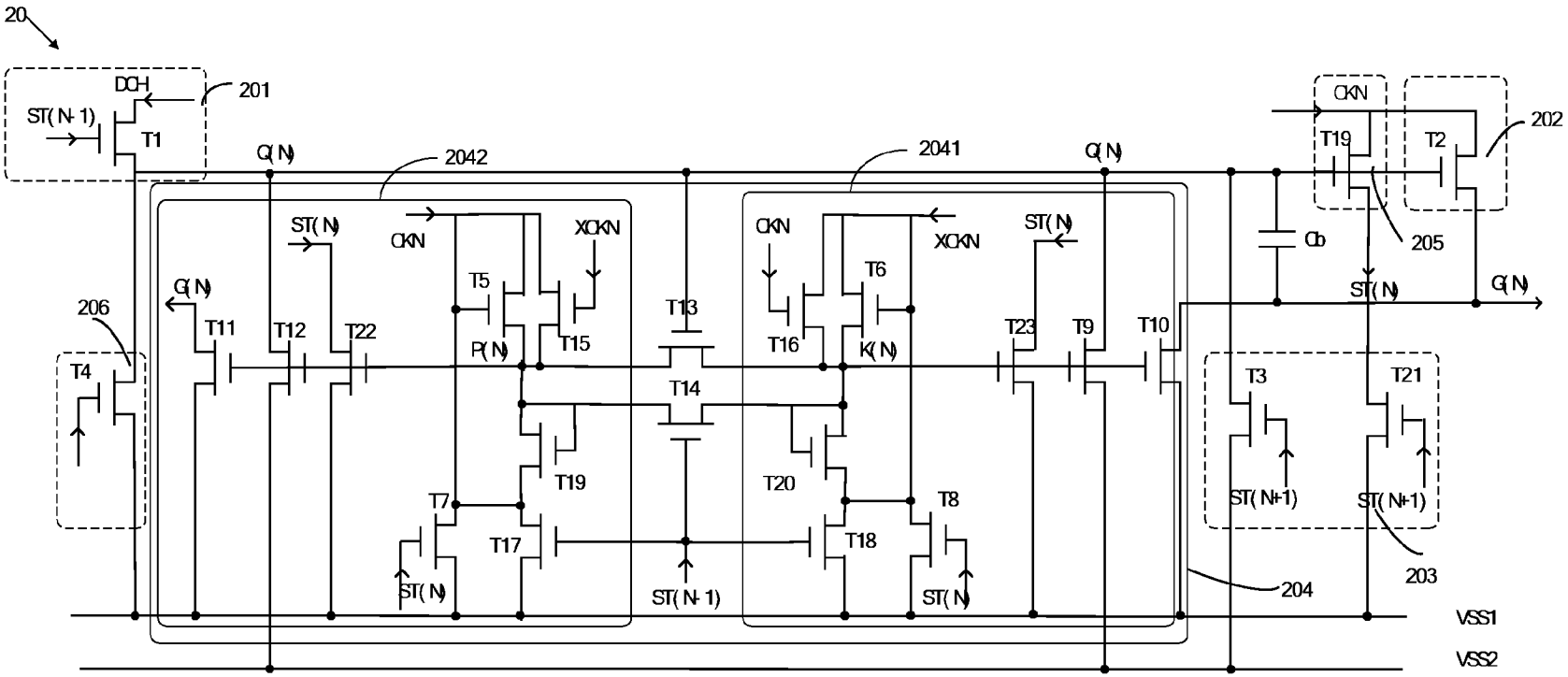
FIG. 2 is a structural diagram of a scan driving circuit according to the first preferred embodiment of the present invention.

Refer to FIG. 2, which is a structural diagram of a scan driving circuit according to the first preferred embodiment of the present invention. The scan driving circuit 20 of the present preferred embodiment includes a pull-up control module 201, a pull-up module 202, a pull-down module 203, a pull-down maintaining module 204, a down-stream module 205, a bootstrap capacitor Cb, and a constant-voltage low-level source.

The pull-up control module 201 is used to receive a previous-level down-stream signal ST(N−1) and generate a scan level signal Q(N) corresponding to one of the scan lines according to the previous-level down-stream signal ST(N−1); a pull-up module 202 is used to pull up a scan signal G(N) of the corresponding scan line according to the scan level signal Q(N) and a present-level clock signal CK(N); a pull-down module 203 is used to pull down a scan signal G(N) of the corresponding scan line according to a next-level down-stream signal ST(N+1); a pull-down maintaining module 204 is used to keep the scan signal G(N) of the corresponding scan line in a low-level; a down-stream module 205 is used to transmit a present-level down-stream signal ST(N) to a next-level of the pull-up control module 201; and a bootstrap capacitor Cb is used to generate a high-level of the scan signal G(N) of the scan line.

A constant-voltage low-level source comprises a first constant-voltage low-level source VSS1 and a second constant-voltage low-level source VSS2. The first constant-voltage low-level source VSS1 provides a first low-level to the pull-down maintaining module 204, and the second constant-voltage low-level source VSS2 provides a second low-level to the pull-down maintaining module 204, wherein the first low-level pulls down the scan signal G(N), the second low-level pulls down the scan level signal Q(N) and the down-stream signal ST(N). An absolute value of the first low-level is smaller than an absolute value of the second low-level.

The pull-up control module 201 comprises a first switch transistor T1, a control end of the first switch transistor T1 inputs the previous-level down-stream signal ST(N−1), an input end of the first switch transistor T1 inputs the constant high-level DCH, and an output end of the first switch transistor T1 is connected to the pull-up module 202, the pull-down module 203, the pull-down maintaining module 204, the down-stream module 205, and the bootstrap capacitor Cb.

The pull-up module 202 comprises a second switch transistor T2, a control end of the second switch transistor T2 is connected to the output end of the first switch transistor T1 of the pull-up control module 201, an input end of the second switch transistor T2 inputs the present-level clock signal CK(N), and an output end of the second switch transistor T2 outputs a present-level of the scan signal G(N).

The down-stream module 205 comprises a third switch transistor T19, a control end of the third switch transistor T19 is connected to the output end of the first switch transistor T1 of the pull-up control module 201, an input end of the third switch transistor T19 inputs the present-level clock signal CK(N), and an output end of the third switch transistor T19 outputs the present-level down-stream signal ST(N).

The pull-down module 203 comprises a fourth switch transistor T3 and a fifth switch transistor T21. A control end of the fourth switch transistor T3 inputs the next-level down-stream signal ST(N+1), an input end of the fourth switch transistor T3 is connected to the output end of the first switch transistor T1 of the pull-up control module, and an output end of the fourth switch transistor T3 is connected to the second constant-voltage low-level source; a control end of the fifth switch transistor T21 inputs the next-level down-stream signal ST(N+1), an input end of the fifth switch transistor T21 is connected to the output end of the third switch transistor T19, and an output end of the fifth switch transistor T21 is connected to the first constant-voltage low-level source.

The pull-down maintaining module 204 comprises a first pull-down maintaining unit 2041, a second pull-down maintaining unit 2042, a twenty-second switch transistor T13, and a twenty-third switch transistor T14.

A control end of the twenty-second switch transistor T13 is connected to the output end of the first switch transistor T1, an output end of the twenty-second switch transistor is connected to a reference point K(N), and an input end of the twenty-second switch transistor is connected to a reference point P(N).

A control end of the twenty-third switch transistor T14 inputs a previous-level down-stream signal ST(N−1), an output end of the twenty-third switch transistor T14 is connected to the reference point K(N), and an input end of the twenty-third switch transistor T14 is connected to the reference point P(N).

The first pull-down maintaining unit 2041 includes a sixth switch transistor T10, a seventh switch transistor T9, an eighth switch transistor T23, a ninth switch transistor T6, a tenth switch transistor T8, a eleventh switch transistor T16, a twelfth switch transistor T20, and a thirteenth switch transistor T18.

A control end of the sixth switch transistor T10 is connected to the reference point K(N), an input end of the sixth switch transistor T10 is connected to the first constant-voltage low-level source VSS1, and an output end of the sixth switch transistor T10 is connected to the output end of the second switch transistor T2.

A control end of the seventh switch transistor T9 is connected to the reference point K(N), an input end of the seventh switch transistor T9 is connected to the second constant-voltage low-level source VSS2, and an output end of the seventh switch transistor T9 is connected to the output end of the first switch transistor T1;

A control end of the eighth switch transistor T23 is connected to the reference point K(N), an input end of the eighth switch transistor T23 is connected to the constant-voltage low-level source VSS1, and an output end of the eighth switch transistor T23 is connected to the present-level down-stream signal ST(N);

A control end of the ninth switch transistor T6 is connected to a first high-frequency impulse signal XCKN (a clock signal), an input end of the ninth switch transistor T6 is connected to the first high-frequency impulse signal XCKN, and an output end of the ninth switch transistor T6 is connected to the reference point K(N);

A control end of the tenth switch transistor T8 is connected to the present-level down-stream signal ST(N), an input end of the tenth switch transistor T8 is connected to the constant-voltage low-level source VSS1, and an output end of the tenth switch transistor T8 is connected to the first high-frequency impulse signal XCKN;

A control end of the eleventh switch transistor T16 is connected to a second high-frequency impulse signal CKN, an input end of the eleventh switch transistor T16 is connected to the first high-frequency impulse signal XCKN, and an output end of the eleventh switch transistor T16 is connected to the reference point K(N);

A control end of the twelfth switch transistor T20 is connected to the reference point K(N), an output end of the twelfth switch transistor T20 is connected to the reference point K(N), and an input end of the twelfth switch transistor T20 is connected to the first high-frequency impulse signal XCKN;

A control end of the thirteenth switch transistor T18 inputs the previous-level down-stream signal ST(N−1), an input end of the thirteenth switch transistor T18 is connected to the constant-voltage low-level source VSS1, and an output end of the thirteenth switch transistor T18 is connected to the first high-frequency impulse signal XCKN.

The second pull-down maintaining unit 2042 includes a fourteenth switch transistor T11, a fifteenth switch transistor T12, a sixteenth switch transistor T22, a seventeenth switch transistor T5, a eighteenth switch transistor T7, a nineteenth switch transistor T15, a twentieth switch transistor T19, and a twenty-first switch transistor T17.

A control end of the fourteenth switch transistor T11 is connected to the reference point P(N), an input end of the fourteenth switch transistor T11 is connected to the first constant-voltage low-level source VSS1, and an output end of the fourteenth switch transistor T11 is connected to the output end of the second switch transistor T2;

A control end of the fifteenth switch transistor T12 is connected to the reference point P(N), an input end of the fifteenth switch transistor T12 is connected to the second constant-voltage low-level source VSS2, and an output end of the fifteenth switch transistor T12 is connected to the output end of the first switch transistor T1;

A control end of the sixteenth switch transistor T22 is connected to the reference point P(N), an input end of the sixteenth switch transistor T22 is connected to the constant-voltage low-level source VSS1, and an output end of the sixteenth switch transistor T22 is connected to the present-level down-stream signal ST(N);

A control end of the seventeenth switch transistor T5 is connected to a second high-frequency impulse signal CKN, an input end of the seventeenth switch transistor T5 is connected to the second high-frequency impulse signal CKN, and an output end of the seventeenth switch transistor T5 is connected to the reference point P(N);

A control end of the eighteenth switch transistor T7 is connected to the present-level down-stream signal ST(N), an input end of the eighteenth switch transistor T7 is connected to the constant-voltage low-level source VSS1, and an output end of the eighteenth switch transistor T7 is connected to the second high-frequency impulse signal CKN;

A control end of the nineteenth switch transistor T15 is connected to a first high-frequency impulse signal XCKN, an input end of the nineteenth switch transistor T15 is connected to the second high-frequency impulse signal CKN, and an output end of the nineteenth switch transistor, and an output end of the nineteenth switch transistor T15 is connected to the reference point P(N);

A control end of the twentieth switch transistor T19 is connected to the reference point P(N), an output end of the twentieth switch transistor T19 is connected to the reference point P(N), and an input end of the twentieth switch transistor T19 is connected to the second high-frequency impulse signal CKN;

A control end of the twenty-first switch transistor T17 inputs the previous-level down-stream signal ST(N−1), an input end of the twenty-first switch transistor T17 is connected to the constant-voltage low-level source VSS1, and an output end of the twenty-first switch transistor is connected to the second high-frequency impulse signal CKN.

An electrical potential of the first high-frequency impulse signal XCKN is opposite to an electrical potential of the second high-frequency impulse signal CKN.

The bootstrap capacitor Cb is set up between the output end of the first switch transistor T1 and the output end of the second switch transistor T2 of the pull-up module 202.

Preferably, the scan driving circuit 20 further comprises the reset module 206 which executes a reset operation for the scan level signal Q(N) of the present-level scan lines. The reset module 206 includes a switch transistor T4. Through inputting a high-level signal to the control end of the switch transistor T4, a reset operation for the scan level signal Q(N) of the scan lines is executed.

Referring to FIG. 2, the scan driving circuit 20 of the preferred embodiment of the present invention is in a working state, when the previous-level down-stream signal ST(N−1) is at a high-level, the first switch transistor is turned on; the constant high-level DCH charges for the bootstrap capacitor Cb through the first switch transistor T1 let the reference point move up to a higher level. Then, the previous-level down-stream signal ST(N−1) is turned into a low-level, and the first switch transistor is turned off; the reference point maintains a higher level through the bootstrap capacitor Cb, and the second switch transistor T2 and the third switch transistor T19 are turned on.

Then, the present-level of the clock signal CKN is turned into a high-level, the clock signal CKN charges continually for the bootstrap capacitor Cb through the second switch transistor so as to let the reference point to achieve a higher level, and the present-level scan signal G(N) and the present-level down-stream signal ST(N) are turned into a high-level.

At this time, the reference point is in a high-level state. Since the input end of the first switch transistor is connected to the constant high-level DCH, electrical leakage does not occur at the reference point through the first switch transistor T1.

At the same time, the twenty-second switch transistor T13 is turned on, the first pull-down maintaining unit and the second pull-down maintaining unit keep the reference point at a high-level due to the effect of the first high-frequency impulse signal and the second high-frequency impulse signal.

When the first high-frequency impulse signal XCKN is at the high-level and the second high-frequency impulse signal CKN is at the low-level, the nineteenth switch transistor T15, the ninth switch transistor T6 and the eighteenth switch transistor T7 are turned on. The nineteenth switch transistor T15 and the eighteenth switch transistor T7 pull down the reference point K(N) and the reference point P(n) into a low electrical potential, so that the sixth switch transistor T10, the seventh switch transistor T11, the eighth switch transistor T23, the fourteenth switch transistor T11, the fifteenth switch transistor T12 and the sixteenth switch transistor T22 are turned off, so as to ensure that the reference point, the present-level pull-down signal ST(N) and the present-level of the scan signal G(N) are at a high electrical potential.

When the first high-frequency impulse signal XCKN is at a low-level and the second high-frequency impulse signal CKN is at a high-level, the seventeenth switch transistor T5, the eleventh switch transistor T16 and the tenth switch transistor T8 are turned on. The eleventh switch transistor T16 and the tenth switch transistor T8 pull down the reference point K(N) and the reference point P(N) into a low electrical potential, so that the sixth switch transistor T10, the seventh switch transistor T11, the eighth switch transistor T23, the fourteenth switch transistor T11, the fifteenth switch transistor T12, and the sixteenth switch transistor T22 are turned off, so as to ensure that the reference point, the present-level pull-down signal ST(N), and the present-level of the scan signal G(N) are at a high electrical potential.

When the next-level pull-down signal ST(N+1) is turned into a high-level, the fourth switch transistor T3 is turned on, the reference point is turned into a low-level. At this time, the twenty-second switch transistor T13 is turned off.

When the first high-frequency impulse signal XCKN is at a high-level, the reference K(N) is pulled up to the high-level, so that the sixth switch transistor T10, the seventh switch transistor T11, and the eighth switch transistor T23 is turned on, so as to ensure that the reference point, the present-level pull-down signal ST(N) and the present-level of the scan signal G(N) are at a low electrical potential.

When the second high-frequency impulse signal CKN is at a high-level, the reference point P(N) is pulled up to the high-level, so that the fourteenth switch transistor T11, the fifteenth switch transistor T12 and the sixteenth T22 are turned on, so as to ensure that the reference point, the present-level pull-down signal ST(N) and the present-level scan signal G(N) are at a low electrical potential.

At the same time, the reference point is pulled shown to the second low-level which is lower than the first low-level in the present preferred embodiment, so as to ensure that the second switch transistor T2 and the third switch transistor T19 is turned off, also avoid the electrical leakage problem of the second switch transistor T2 affecting the electrical potential of the scan signal G(N) and avoid the electrical leakage problem of the third switch transistor T19 affecting the electrical potential of the present-level down-stream signal ST(N).

In summary, in the scan driving circuit of the present preferred embodiment, whether the reference point is at a high-level state or a low-level state, the electrical potential of the reference point can be maintained, so as to avoid the electrical leakage causing the electrical potential of the reference point to be changed.

Through setting constant-voltage low-level source with many different electrical potentials, the present invention can avoid an electrical leakage problem successfully so as to improve the reliability of the scan driving circuit.

Figure 3:
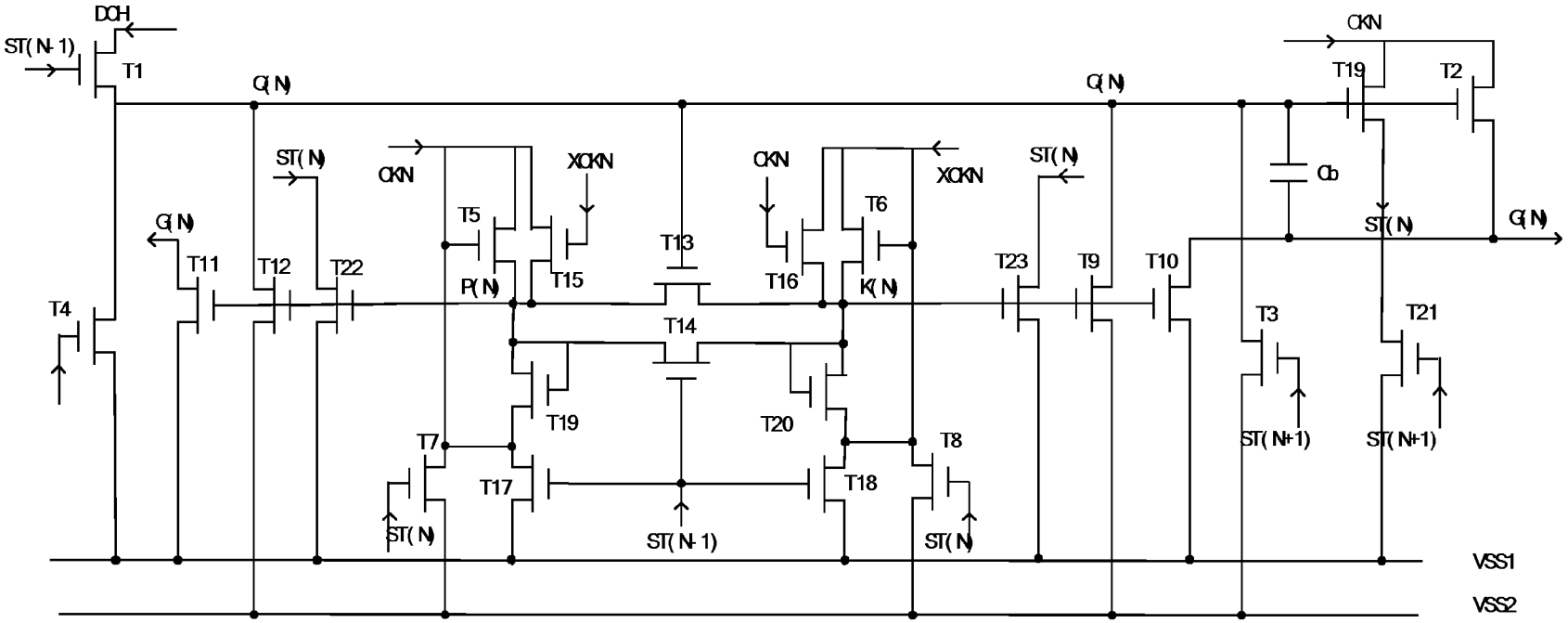
FIG. 3 is a structural diagram of a scan driving circuit according to the second preferred embodiment of the present invention.

Refer to FIG. 3, which is a structural diagram of a scan driving circuit according to the second preferred embodiment of the present invention. The difference between the scan driving circuit of the present preferred embodiment and the scan driving circuit of the first preferred embodiment is: the input end of the tenth switch transistor T8 and the input end of the eighteenth switch transistor T7 are both connected to the second constant-voltage low-level source, so that the tenth switch transistor T8 and the eighteenth switch transistor T7 not to have electrical leakage, so as to not affect the electrical potential of the reference point K(N) and the reference point P(N); furthermore, this improves the reliability of the scan driving circuit.

Figure 4:
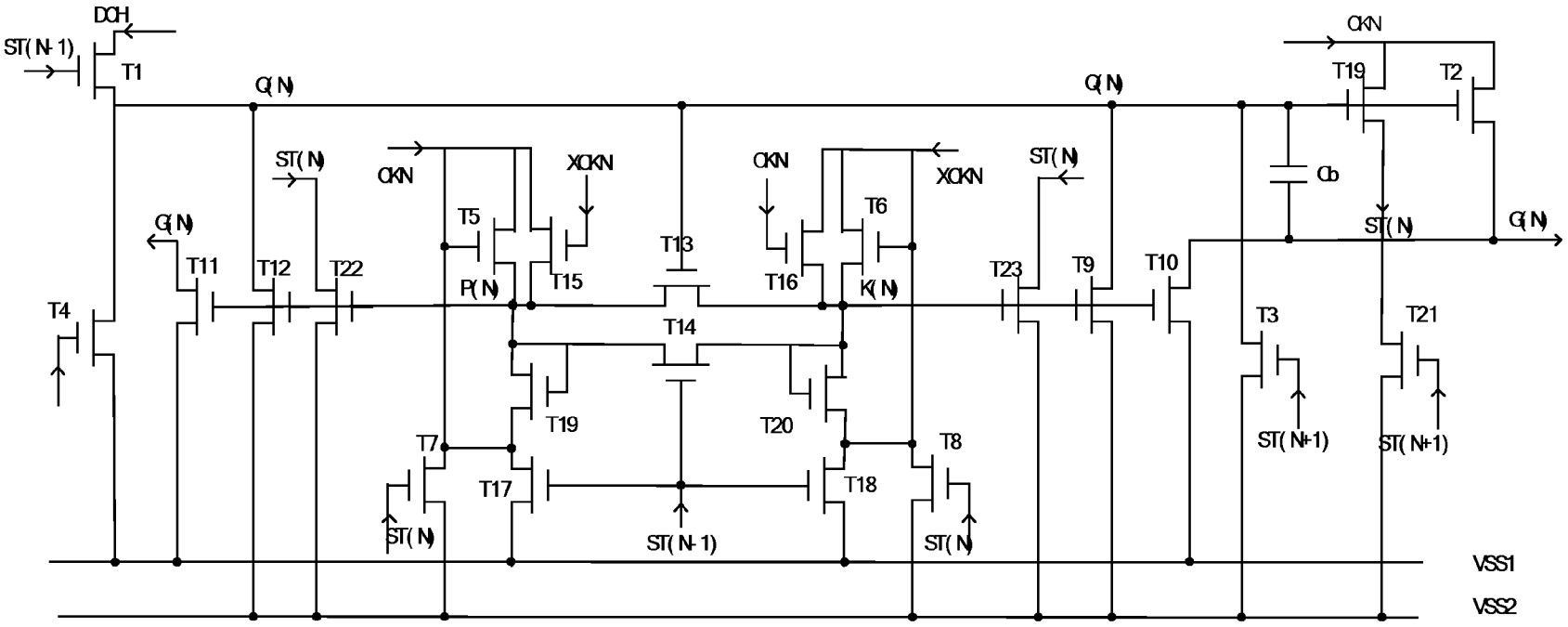
FIG. 4 is a structural diagram of a scan driving circuit according to the third preferred embodiment of the present invention.

Refer to FIG. 4, which is a structural diagram of a scan driving circuit according to the third preferred embodiment of the present invention. The difference between the scan driving circuit of the present preferred embodiment and the scan driving circuit of the second preferred embodiment is: the input end of the fifth switch transistor T21, the input end of the eighth switch transistor T23 and the input end of the sixteenth switch transistor T22 are all connected to the second constant-voltage low-level source, so that the fifth switch transistor T21, the eighth switch transistor T23, and the sixteenth switch transistor T22 not to have electrical leakage, so as to not affect the electrical potential of the present-level down-stream signal ST(N); furthermore, this improves the reliability of the scan driving circuit.

Figure 5:
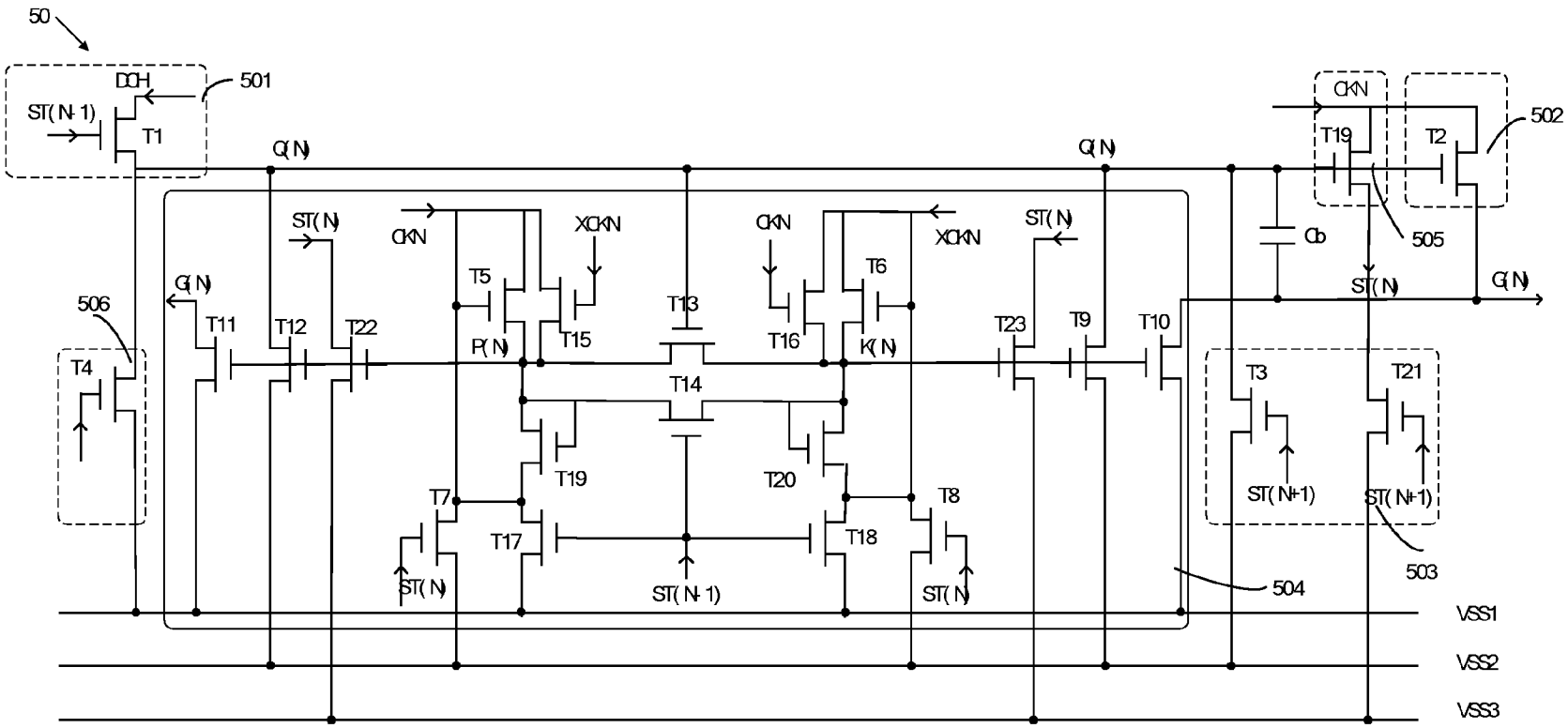
FIG. 5 is a structural diagram of a scan driving circuit according to the fourth preferred embodiment of the present invention.
Figure 6:
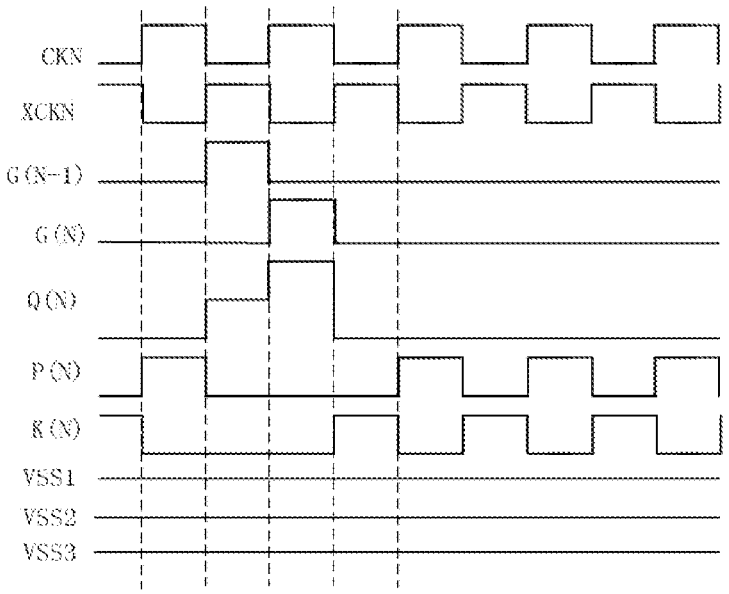
FIG. 6 is a signal waveform diagram of a scan driving circuit according to the fourth preferred embodiment of the present invention.

Refer to FIG. 5 and FIG. 6. FIG. 5 is a structural diagram of a scan driving circuit according to the fourth preferred embodiment of the present invention; and FIG. 6 is a signal waveform diagram of a scan driving circuit according to the fourth preferred embodiment of the present invention. The scan driving circuit 50 of the present preferred embodiment includes a pull-up control module 501, pull-up module 502, pull-down module 503, pull-down maintaining module 504, a down-stream module 505, a reset module 506, a bootstrap capacitor Cb, and a constant-voltage low-level source. In the present preferred embodiment, the constant-voltage low-level source of scan driving circuit comprises a first constant-voltage low-level source VSS1, a second constant-voltage low-level source VSS2, and a third constant-voltage low-level source VSS3. The first constant-voltage low-level source VSS1 is used to provide a first low-level to the pull-down maintaining module, the second constant-voltage low-level source is used to provide a second low-level to the pull-down maintaining module, and the third constant-voltage low-level source is used to provide a third low-level to the pull-down maintaining module; the first low-level pulls down the scan signal G(N), the second low-level pulls down the scan level signal Q(N), and the third low-level pulls down the down-stream signal ST(N); and an absolute value of the first low-level is smaller than an absolute value of the second low-level, while the absolute value of the second low-level is smaller than an absolute value of the third low-level.

The output end of the fifth switch transistor T21 of the pull-down module 503 is connected to the third constant-voltage low-level source VSS3, the input end of the eighth switch transistor T23 of the pull-down maintaining module 504 is connected to the third constant-voltage low-level source VSS3, and the input end of the fifteenth switch transistor T22 of the pull-down maintaining module 504 is connected to the third constant-voltage low-level source VSS3.

The output end of the fourth switch transistor T3 of the pull-down module 503 is connected to the second constant-voltage low-level source VSS2; the input end of the seventh switch transistor T9 of the pull-down maintaining module 504 is connected to the second constant-voltage low-level source VSS2; the input end of the tenth switch transistor T8 of the pull-down maintaining module 504 is connected to the second constant-voltage low-level source VSS2; the input end of the fifteenth switch transistor T12 of the pull-down maintaining module 504 is connected to the second constant-voltage low-level source VSS2; and the input end of the eighteenth switch transistor T7 of the pull-down maintaining module 504 is connected to the second constant-voltage low-level source VSS2.

The input end of the sixth switch transistor T10 of the pull-down maintaining module 504 is connected to the first constant-voltage low-level source VSS1; the input end of the thirteenth switch transistor T18 of the pull-down maintaining module 504 is connected to the first constant-voltage low-level source VSS1; the input end of the fourteenth switch transistor T11 of the pull-down maintaining module 504 is connected to the first constant-voltage low-level source VSS1; and the input end of the twenty-first switch transistor T17 of the pull-down maintaining module 504 is connected to the first constant-voltage low-level source VSS1.

The scan driving circuit of the present preferred embodiment can pull down the present-level pull-down signal ST(N) through setting up three constant-voltage low-level sources, so that the tenth switch transistor T8 and the eighteenth switch transistor T7 are turned off, so as to ensure the reference point K(N) and the reference point P(N) have a high electrical potential.

Figure 7:
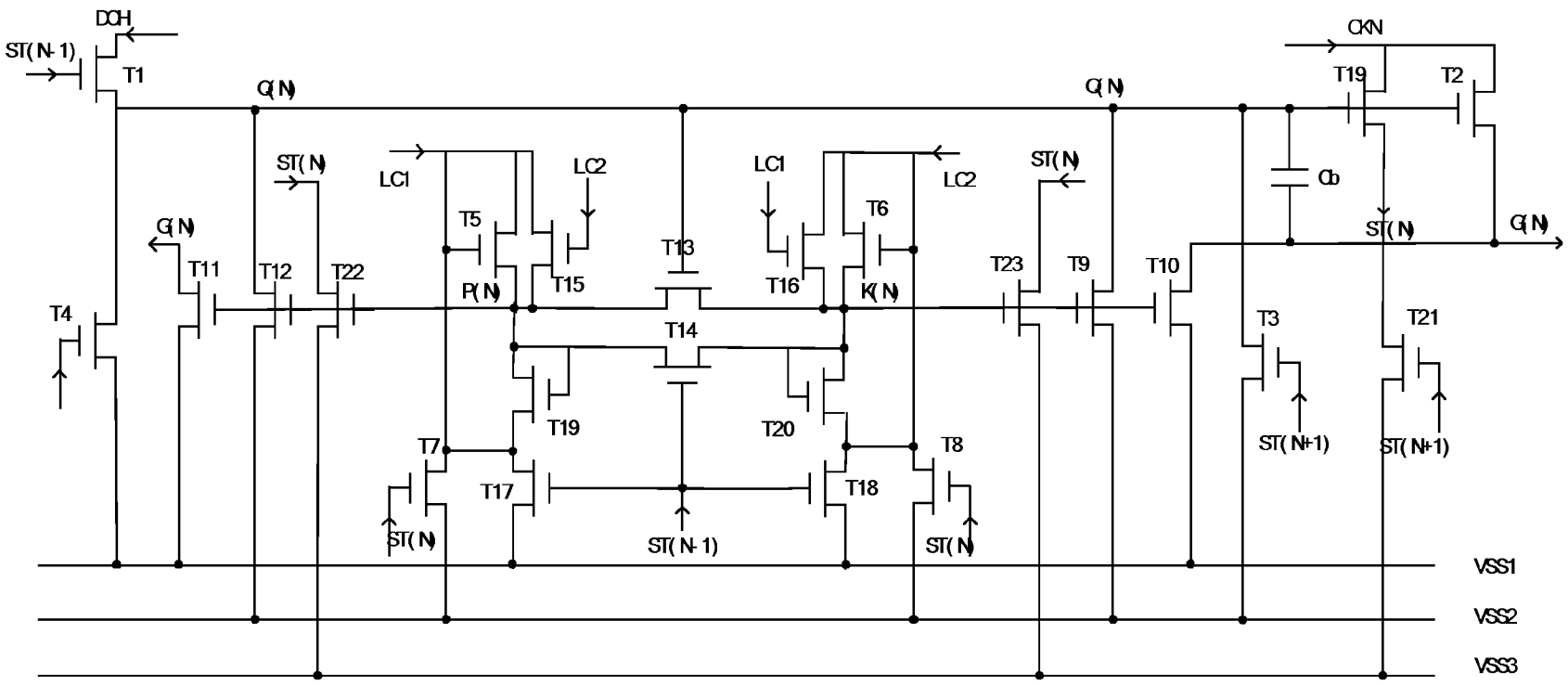
FIG. 7 is a structural diagram of a scan driving circuit according to the fifth preferred embodiment of the present invention.
Figure 8:
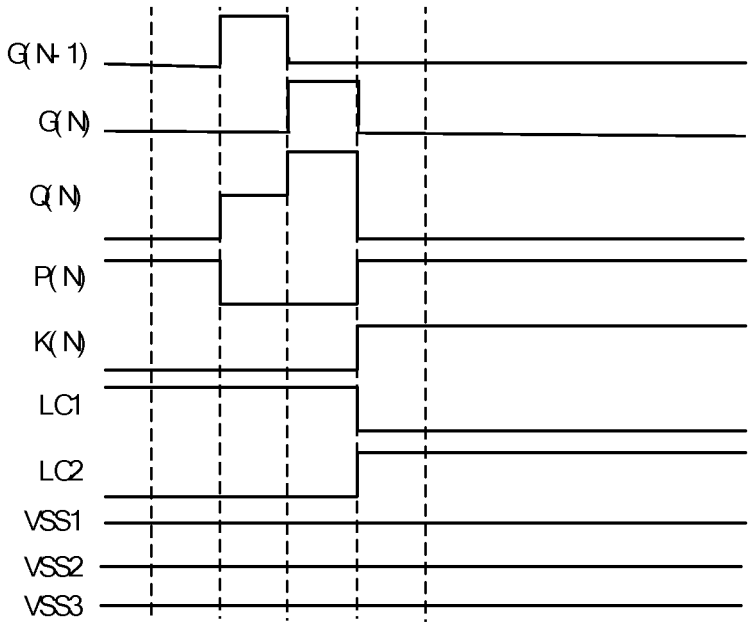
FIG. 8 is a signal waveform diagram of a scan driving circuit according to the fifth preferred embodiment of the present invention.

Refer to FIG. 7 and FIG. 8. FIG. 7 is a structural diagram of a scan driving circuit according to the fifth preferred embodiment of the present invention; and FIG. 8 is a signal waveform diagram of a scan driving circuit according to the fifth preferred embodiment of the present invention. The difference between the scan driving circuit of the present preferred embodiment and the scan driving circuit of the fourth preferred embodiment is: using a first low-frequency electrical potential signal LC2 to replace the first high-frequency impulse signal XCKN, and using a second low-frequency electrical potential signal LC1 to replace the second high-frequency impulse signal CKN. The first low-frequency electrical potential signal LC2 and the second low-frequency electrical potential signal LC1 can convert the electrical potential after several frames screen or dozens frames screen, thereby reducing the impulse switch operation of the scan driving circuit, so as to save power of the scan driving circuit.

Through setting constant-voltage low-level sources with many different electrical potentials, the present invention can avoid an electrical leakage problem successfully so as to improve the reliability of a scan driving circuit; the present invention solves the easily occurring electrical leakage problem of the existing scan driving circuit, so as to affect the reliability of the scan driving circuit.

In summary, the present invention has been disclosed with preferred embodiments thereof, but the above described preferred embodiments are not intended to limit the present invention. Those who are skilled in the art can make many changes and modifications to the described embodiment which can be carried out without departing from the scope and the spirit of the invention that is intended to be limited only by the appended claims.

What is claimed is:

1. A scan driving circuit, executing a driving operation for cascaded scan lines, comprising:

a pull-up control module receiving a previous-level down-stream signal, and generating a scan level signal corresponding to one of the scan lines according to the previous-level down-stream signal;

a pull-up module pulling up a scan signal of the corresponding scan line according to the scan level signal and a present-level clock signal;

a pull-down module pulling down a scan signal of the corresponding scan line according to a next-level down-stream signal;

a pull-down maintaining module keeping the scan signal of the corresponding scan line in a low-level;

a down-stream module transmitting a present-level down-stream signal to a next-level of the pull-up control module;

a bootstrap capacitor generating a high-level of the scan signal of the scan line;

a reset module executing a reset operation for the scan level signal of the present-level scan line;

a constant-voltage low-level source, comprising:

a first constant-voltage low-level source providing a first low-level to the pull-down maintaining module, wherein the first low-level pulls down the scan signal; and a second constant-voltage low-level source providing a second low-level to the pull-down maintaining module, wherein the second low-level pulls down the scan level signal and the down-stream signal;

wherein an absolute value of the first low-level is smaller than an absolute value of the second low-level;

wherein the pull-up control module comprises a first switch transistor, a control end of the first switch transistor inputs the previous-level down-stream signal, an input end of the first switch transistor inputs the constant high-level, and an output end of the first switch transistor is connected to the pull-up module, the pull-down module, the pull-down maintaining module, the down-stream module, and the bootstrap capacitor.

2. The scan driving circuit according to claim 1, wherein the pull-up module comprises a second switch transistor, a control end of the second switch transistor is connected to the output end of the first switch transistor of the pull-up control module, an input end of the second switch transistor inputs the present-level clock signal, and an output end of the second switch transistor outputs a present-level of the scan signal.

3. The scan driving circuit according to claim 1, wherein the down-stream module comprises a third switch transistor, a control end of the third switch transistor is connected to the output end of the first switch transistor of the pull-up control module, an input end of the third switch transistor inputs the present-level clock signal, and an output end of the third switch transistor outputs the present-level down-stream signal.

4. The scan driving circuit according to claim 3, wherein the pull-down module comprises a fifth switch transistor, a control end of the fifth switch transistor inputs the next-level down-stream signal, an input end of the fifth switch transistor is connected to the output end of the third switch transistor, and an output end of the fifth switch transistor is connected to the first constant-voltage low-level source.

5. The scan driving circuit according to claim 1, wherein the pull-down module comprises a fourth switch transistor, a control end of the fourth switch transistor inputs the next-level down-stream signal, an input end of the fourth switch transistor is connected to the output end of the first switch transistor of the pull-up control module, and an output end of the fourth switch transistor is connected to the second constant-voltage low-level source.

6. The scan driving circuit according to claim 1, wherein the pull-down maintaining module comprises a first pull-down maintaining unit, a second pull-down maintaining unit, a twenty-second switch transistor and a twenty-third switch transistor;

wherein a control end of the twenty-second switch transistor is connected to the output end of the first switch transistor, an output end of the twenty-second switch transistor is connected to a reference point K(N), and an input end of the twenty-second switch transistor is connected to a reference point P(N);

wherein a control end of the twenty-third switch transistor inputs a previous-level down-stream signal, an output end of the twenty-third switch transistor is connected to the reference point K(N), and an input end of the twenty-third switch transistor is connected to the reference point P(N);

wherein the first pull-down maintaining unit includes a sixth switch transistor, a seventh switch transistor, an eighth switch transistor, a ninth switch transistor, a tenth switch transistor, a eleventh switch transistor, a twelfth switch transistor, and a thirteenth switch transistor;

wherein a control end of the sixth switch transistor is connected to the reference point K(N), an input end of the sixth switch transistor is connected to the first constant-voltage low-level source, and an output end of the sixth switch transistor is connected to the output end of the second switch transistor;

wherein a control end of the seventh switch transistor is connected to the reference point K(N), an input end of the seventh switch transistor is connected to the second constant-voltage low-level source, and an output end of the seventh switch transistor is connected to the output end of the first switch transistor;

wherein a control end of the eighth switch transistor is connected to the reference point K(N), an input end of the eighth switch transistor is connected to the first constant-voltage low-level source, and an output end of the eighth switch transistor is connected to the present-level down-stream signal;

wherein a control end of the ninth switch transistor is connected to a first high-frequency impulse signal, an input end of the ninth switch transistor is connected to the first high-frequency impulse signal, and an output end of the ninth switch transistor is connected to the reference point K(N);

wherein a control end of the tenth switch transistor is connected to the present-level down-stream signal, an input end of the tenth switch transistor is connected to the first constant-voltage low-level source, and an output end of the tenth switch transistor is connected to the first high-frequency impulse signal;

wherein a control end of the eleventh switch transistor is connected to a second high-frequency impulse signal, an input end of the eleventh switch transistor is connected to the first high-frequency impulse signal, and an output end of the eleventh switch transistor is connected to the reference point K(N);

wherein a control end of the twelfth switch transistor is connected to the reference point K(N), an output end of the twelfth switch transistor is connected to the reference point K(N), and an input end of the twelfth switch transistor is connected to the first high-frequency impulse signal;

wherein a control end of the thirteenth switch transistor inputs the previous-level down-stream signal, an input end of the thirteenth switch transistor is connected to the first constant-voltage low-level source, and an output end of the thirteenth switch transistor is connected to the first high-frequency impulse signal;

wherein the second pull-down maintaining unit includes a fourteenth switch transistor, a fifteenth switch transistor, a sixteenth switch transistor, a seventeenth switch transistor, a eighteenth switch transistor, a nineteenth switch transistor, a twentieth switch transistor, and a twenty-first switch transistor;

wherein a control end of the fourteenth switch transistor is connected to the reference point P(N), an input end of the fourteenth switch transistor is connected to the first constant-voltage low-level source, and an output end of the fourteenth switch transistor is connected to the output end of the second switch transistor;

wherein a control end of the fifteenth switch transistor is connected to the reference point P(N), an input end of the fifteenth switch transistor is connected to the second constant-voltage low-level source, and an output end of the fifteenth switch transistor is connected to the output end of the first switch transistor;

wherein a control end of the sixteenth switch transistor is connected to the reference point P(N), an input end of the sixteenth switch transistor is connected to the first constant-voltage low-level source, and an output end of the sixteenth switch transistor is connected to the present-level down-stream signal;

wherein a control end of the seventeenth switch transistor is connected to a second high-frequency impulse signal, an input end of the seventeenth switch transistor is connected to the second high-frequency impulse signal, and an output end of the seventeenth switch transistor is connected to the reference point P(N);

wherein a control end of the eighteenth switch transistor is connected to the present-level down-stream signal, an input end of the eighteenth switch transistor is connected to the first constant-voltage low-level source, and an output end of the eighteenth switch transistor is connected to the second high-frequency impulse signal;

wherein a control end of the nineteenth switch transistor is connected to a first high-frequency impulse signal, an input end of the nineteenth switch transistor is connected to the second high-frequency impulse signal, and an output end of the nineteenth switch transistor is connected to the reference point P(N);

wherein a control end of the twentieth switch transistor is connected to the reference point P(N), an output end of the twentieth switch transistor is connected to the reference point P(N), and an input end of the twentieth switch transistor is connected to the second high-frequency impulse signal;

wherein a control end of the twenty-first switch transistor inputs the previous-level down-stream signal, an input end of the twenty-first switch transistor is connected to the first constant-voltage low-level source, and an output end of the twenty-first switch transistor is connected to the second high-frequency impulse signal.

7. The scan driving circuit according to claim 6, wherein an electrical potential of the first high-frequency impulse signal is opposite to an electrical potential of the second high-frequency impulse signal.

8. The scan driving circuit according to claim 1, wherein the constant-voltage low-level source further comprises: a third constant-voltage low-level source providing a third low-level to the pull-down maintaining module, wherein the third low-level pulls down the down-stream signal; wherein the absolute value of the second low-level is smaller than an absolute value of the third low-level.

9. The scan driving circuit according to claim 8, wherein an output end of a fifth switch transistor of the pull-down module is connected to the third constant-voltage low-level source, an input end of an eighth switch transistor of the pull-down maintaining module is connected to the third constant-voltage low-level source, and an input end of a sixteenth switch transistor of the pull-down maintaining module is connected to the third constant-voltage low-level source;

wherein an output end of the fourth switch transistor of the pull-down module is connected to the second constant-voltage low-level source; an input end of a seventh switch transistor of the pull-down maintaining module is connected to the second constant-voltage low-level source; an input end of a tenth switch transistor of the pull-down maintaining module is connected to the second constant-voltage low-level source; an input end of a fifteenth switch transistor of the pull-down maintaining module is connected to the second constant-voltage low-level source; and an input end of a eighteenth switch transistor of the pull-down maintaining module is connected to the second constant-voltage low-level source;

wherein an input end of a sixth switch transistor of the pull-down maintaining module is connected to the first constant-voltage low-level source; an input end of a thirteenth switch transistor of the pull-down maintaining module is connected to the first constant-voltage low-level source; an input end of a fourteenth switch transistor of the pull-down maintaining module is connected to the first constant-voltage low-level source; and an input end of a twenty-first switch transistor of the pull-down maintaining module is connected to the first constant-voltage low-level source.

10. A scan driving circuit, executing a driving operation for cascaded scan lines, comprising:

a pull-up control module receiving a previous-level down-stream signal, and generating a scan level signal corresponding to one of the scan lines according to the previous-level down-stream signal;

a pull-up module pulling up a scan signal of the corresponding scan line according to the scan level signal and a present-level clock signal;

a pull-down module pulling down a scan signal of the corresponding scan line according to a next-level down-stream signal;

a pull-down maintaining module keeping the scan signal of the corresponding scan line in a low-level;

a down-stream module transmitting a present-level down-stream signal to a next-level of the pull-up control module;

a bootstrap capacitor generating a high-level of the scan signal of the scan line; and a constant-voltage low-level source, comprising:

a first constant-voltage low-level source providing a first low-level to the pull-down maintaining module, wherein the first low-level pulls down the scan signal; and a second constant-voltage low-level source providing a second low-level to the pull-down maintaining module, wherein the second low-level pulls down the scan level signal and the down-stream signal;

wherein an absolute value of the first low-level is smaller than an absolute value of the second low-level.

11. The scan driving circuit according to claim 10, wherein the pull-up control module comprises a first switch transistor, a control end of the first switch transistor inputs the previous-level down-stream signal, an input end of the first switch transistor inputs the constant high-level, an output end of the first switch transistor is connected to the pull-up module, the pull-down module, the pull-down maintaining module, the down-stream module, and the bootstrap capacitor.

12. The scan driving circuit according to claim 11, wherein the pull-up module comprises a second switch transistor, a control end of the second switch transistor is connected to the output end of the first switch transistor of the pull-up control module, an input end of the second switch transistor inputs the present-level clock signal, and an output end of the second switch transistor outputs a present-level of the scan signal.

13. The scan driving circuit according to claim 11, wherein the down-stream module comprises a third switch transistor, a control end of the third switch transistor is connected to the output end of the first switch transistor of the pull-up control module, an input end of the third switch transistor inputs the present-level clock signal, and an output end of the third switch transistor outputs the present-level down-stream signal.

14. The scan driving circuit according to claim 13, wherein the pull-down module comprises a fifth switch transistor, a control end of the fifth switch transistor inputs the next-level down-stream signal, an input end of the fifth switch transistor is connected to the output end of the third switch transistor, and an output end of the fifth switch transistor is connected to the first constant-voltage low-level source.

15. The scan driving circuit according to claim 11, wherein the pull-down module comprises a fourth switch transistor, a control end of the fourth switch transistor inputs the next-level down-stream signal, an input end of the fourth switch transistor is connected to the output end of the first switch transistor of the pull-up control module, and an output end of the fourth switch transistor is connected to the second constant-voltage low-level source.

16. The scan driving circuit according to claim 11, wherein the pull-down maintaining module comprises a first pull-down maintaining unit, a second pull-down maintaining unit, a twenty-second switch transistor and a twenty-third switch transistor;

wherein a control end of the twenty-second switch transistor is connected to the output end of the first switch transistor, an output end of the twenty-second switch transistor is connected to a reference point K(N), and an input end of the twenty-second switch transistor is connected to a reference point P(N);

wherein a control end of the twenty-third switch transistor inputs a previous-level down-stream signal, an output end of the twenty-third switch transistor is connected to the reference point K(N), and an input end of the twenty-third switch transistor is connected to the reference point P(N);

wherein the first pull-down maintaining unit includes a sixth switch transistor, a seventh switch transistor, an eighth switch transistor, a ninth switch transistor, a tenth switch transistor, a eleventh switch transistor, a twelfth switch transistor, and a thirteenth switch transistor;

wherein a control end of the sixth switch transistor is connected to the reference point K(N), an input end of the sixth switch transistor is connected to the first constant-voltage low-level source, and an output end of the sixth switch transistor is connected to the output end of the second switch transistor;

wherein a control end of the seventh switch transistor is connected to the reference point K(N), an input end of the seventh switch transistor is connected to the second constant-voltage low-level source, and an output end of the seventh switch transistor is connected to the output end of the first switch transistor;

wherein a control end of the eighth switch transistor is connected to the reference point K(N), an input end of the eighth switch transistor is connected to the first constant-voltage low-level source, and an output end of the eighth switch transistor is connected to the present-level down-stream signal;

wherein a control end of the ninth switch transistor is connected to a first high-frequency impulse signal, an input end of the ninth switch transistor is connected to the first high-frequency impulse signal, and an output end of the ninth switch transistor is connected to the reference point K(N);

wherein a control end of the tenth switch transistor is connected to the present-level down-stream signal, an input end of the tenth switch transistor is connected to the first constant-voltage low-level source, and an output end of the tenth switch transistor is connected to the first high-frequency impulse signal;

wherein a control end of the eleventh switch transistor is connected to a second high-frequency impulse signal, an input end of the eleventh switch transistor is connected to the first high-frequency impulse signal, and an output end of the eleventh switch transistor is connected to the reference point K(N);

wherein a control end of the twelfth switch transistor is connected to the reference point K(N), an output end of the twelfth switch transistor is connected to the reference point K(N), and an input end of the twelfth switch transistor is connected to the first high-frequency impulse signal;

wherein a control end of the thirteenth switch transistor inputs the previous-level down-stream signal, an input end of the thirteenth switch transistor is connected to the first constant-voltage low-level source, and an output end of the thirteenth switch transistor is connected to the first high-frequency impulse signal;

wherein the second pull-down maintaining unit includes a fourteenth switch transistor, a fifteenth switch transistor, a sixteenth switch transistor, a seventeenth switch transistor, a eighteenth switch transistor, a nineteenth switch transistor, a twentieth switch transistor, and a twenty-first switch transistor;

wherein a control end of the fourteenth switch transistor is connected to the reference point P(N), an input end of the fourteenth switch transistor is connected to the first constant-voltage low-level source, and an output end of the fourteenth switch transistor is connected to the output end of the second switch transistor;

wherein a control end of the fifteenth switch transistor is connected to the reference point P(N), an input end of the fifteenth switch transistor is connected to the second constant-voltage low-level source, and an output end of the fifteenth switch transistor is connected to the output end of the first switch transistor;

wherein a control end of the sixteenth switch transistor is connected to the reference point P(N), an input end of the sixteenth switch transistor is connected to the first constant-voltage low-level source, and an output end of the sixteenth switch transistor is connected to the present-level down-stream signal;

wherein a control end of the seventeenth switch transistor is connected to a second high-frequency impulse signal, an input end of the seventeenth switch transistor is connected to the second high-frequency impulse signal, and an output end of the seventeenth switch transistor is connected to the reference point P(N);

wherein a control end of the eighteenth switch transistor is connected to the present-level down-stream signal, an input end of the eighteenth switch transistor is connected to the first constant-voltage low-level source, and an output end of the eighteenth switch transistor is connected to the second high-frequency impulse signal;

wherein a control end of the nineteenth switch transistor is connected to a first high-frequency impulse signal, an input end of the nineteenth switch transistor is connected to the second high-frequency impulse signal, and an output end of the nineteenth switch transistor is connected to the reference point P(N);

wherein a control end of the twentieth switch transistor is connected to the reference point P(N), an output end of the twentieth switch transistor is connected to the reference point P(N), and an input end of the twentieth switch transistor is connected to the second high-frequency impulse signal;

wherein a control end of the twenty-first switch transistor inputs the previous-level down-stream signal, an input end of the twenty-first switch transistor is connected to the first constant-voltage low-level source, and an output end of the twenty-first switch transistor is connected to the second high-frequency impulse signal.

17. The scan driving circuit according to claim 16, wherein an electrical potential of the first high-frequency impulse signal is opposite to an electrical potential of the second high-frequency impulse signal.

18. The scan driving circuit according to claim 10, wherein the constant-voltage low-level source further comprises: a third constant-voltage low-level source providing a third low-level to the pull-down maintaining module, wherein the third low-level pulls down the down-stream signal; wherein the absolute value of the second low-level is smaller than an absolute value of the third low-level.

19. The scan driving circuit according to claim 18, wherein an output end of a fifth switch transistor of the pull-down module is connected to the third constant-voltage low-level source, an input end of an eighth switch transistor of the pull-down maintaining module is connected to the third constant-voltage low-level source, and an input end of a sixteenth switch transistor of the pull-down maintaining module is connected to the third constant-voltage low-level source;

wherein an output end of the fourth switch transistor of the pull-down module is connected to the second constant-voltage low-level source; an input end of a seventh switch transistor of the pull-down maintaining module is connected to the second constant-voltage low-level source; an input end of a tenth switch transistor of the pull-down maintaining module is connected to the second constant-voltage low-level source; an input end of a fifteenth switch transistor of the pull-down maintaining module is connected to the second constant-voltage low-level source; and an input end of a eighteenth switch transistor of the pull-down maintaining module is connected to the second constant-voltage low-level source;

wherein an input end of a sixth switch transistor of the pull-down maintaining module is connected to the first constant-voltage low-level source; an input end of a thirteenth switch transistor of the pull-down maintaining module is connected to the first constant-voltage low-level source; an input end of a fourteenth switch transistor of the pull-down maintaining module is connected to the first constant-voltage low-level source; and an input end of a twenty-first switch transistor of the pull-down maintaining module is connected to the first constant-voltage low-level source.

20. The scan driving circuit according to claim 10, wherein the scan driving circuit further comprises:

a reset module executing a reset operation for the scan level signal of the present-level scan line.

* * * * *